United States Patent [19]

Goodfellow

[11] Patent Number: 4,630,693

[45] Date of Patent: Dec. 23, 1986

[54] ROTARY CUTTER ASSEMBLY

[76] Inventor: Robert D. Goodfellow, Meadowbrook Ter., Bedford, Pa. 15522

[21] Appl. No.: 723,139

[22] Filed: Apr. 15, 1985

[51] Int. Cl.[4] ..... F21B 10/20

[52] U.S. Cl. ..... 175/366; 175/374

[58] Field of Search ..... 175/337–339, 175/364, 367, 368, 366, 412, 413, 342, 374; 299/91; 384/92–96

[56] References Cited

U.S. PATENT DOCUMENTS

| | | | |
|---|---|---|---|
| 2,065,743 | 12/1936 | Reed | 175/366 |
| 2,648,526 | 8/1953 | Lanchester | 175/366 X |
| 3,921,734 | 12/1975 | Goodfellow | 175/364 |
| 4,036,313 | 7/1977 | Dixon et al. | 175/364 X |
| 4,036,314 | 7/1977 | Dixon et al. | 175/364 |
| 4,202,418 | 5/1980 | Waddell | 175/364 X |

FOREIGN PATENT DOCUMENTS

| | | | |
|---|---|---|---|
| 54521 | 5/1943 | Netherlands | 175/366 |

*Primary Examiner*—Stephen J. Novosad
*Assistant Examiner*—David J. Bagnell
*Attorney, Agent, or Firm*—Prutzman, Kalb, Chilton & Alix

[57] ABSTRACT

A rotary cutter assembly employs a wear sleeve to improve the durability of the drill head and to seal off a fluid passageway in the shank of a drill bit which is mounted to the drill head. The shank of the drill bit is releasably secured to the drill head by means of lock pins received in intersecting complementary longitudinally and transversely extending grooves. A lock ring is also employed to axially secure the drill bit to the drill head.

9 Claims, 4 Drawing Figures

ROTARY CUTTER ASSEMBLY

BACKGROUND OF THE INVENTION

This invention relates to rotary cutter assemblies of the type employed in earth boring applications. More particularly, this invention relates to rotary cutter assemblies which employ rotary cone cutters for drilling wells, blast holes and the like.

Rotary cutter assemblies which employ multiple cutters for rotation about multiple axes of rotation in cooperating fashion to drill earth and hard rock formations are well-known. Many such cutter assemblies employ bit assemblies having legs or connector structures which carry the rotary cutters. The cutter assemblies may also provide means for conducting a flushing fluid from the drill string through the cutter assembly to the bottom of the drill hole. Naturally, the intense work environment of the rotary cutter assembly dictates that the assemblies be constructed in a manner which produces a high degree of structural integrity. Consequently, the connector structures and cutters are commonly pre-assembled at a manufacturing location and are permanently welded together to provide a rotary cutter assembly of an integral form which is then coupled to the drill string of the drill rig.

In the environment to which the rotary cutter assembly of the present invention is ordinarily subjected, frequent replacement of the rolling cutters is common due to the harsh conditions produced by dirt, dust, shock, heat and vibration. During drilling operations the cuttings are commonly blasted against the cutter assembly resulting in pitting, cavitation and other adverse structural damage which ordinarily significantly shortens the useful life of the cutter assembly. Disproportionate wear to one of the multiple rotary cutters or breakage of one of the rotary cutters may effectively disable the entire rotary cutter assembly—especially in light of the fact that the rotary multiple cutters operate in a cooperative fashion. A principal aim of the present invention is to enhance the durability characteristics of a multiple cutter assembly for extending the useful life of the rotary cutter assembly as well as to provide a rotary cutter assembly which permits the replacement of one of the rotary cutters without requiring the replacement of the entire assembly.

A number of rotary cutter assemblies have incorporated features which provide a high degree of structural integrity while also providing for relatively easy replacement of one of the multiple rotary cutters if required. For example, in U.S. Pat. No. 4,335,794 issued to Robert D. Goodfellow, the inventor herein, and entitled "ROTARY CUTTER", a multi-cone roller bit is disclosed wherein the rotary cone cutter is provided with individual releasable legs that permit replacement of a single defective roller cutter unit without requiring that the entire rotary cutter assembly be replaced. All of the releasable legs of U.S. Pat. No. 4,335,794 are clamped to a pot member by a single plug member so that all the rotary cutter units are essentially clamped in place or are released substantially simultaneously. In U.S. patent application Ser. No. 580,368 filed Feb. 15, 1984 by the inventor herein and entitled "ROTARY CUTTER ASSEMBLY", an improved rotary cutter assembly employs a lock sleeve which connects transverse fluid passageways of the drill head and the bit assembly for releasably securing each rotary cutter bit assembly to the drill head. Transverse locking means in the form of pins which are received in complementary slots parallel to the rotational axis of the rotary cutter assembly are also employed to secure the bit assemblies to the drill head. The present invention incorporates new and improved means for securing the cutter bit assemblies to a drill head to provide a multiple bit rotary cutter assembly having enhanced durability characteristics and an extended useful life.

BRIEF SUMMARY OF THE INVENTION

Briefly stated, the invention in a preferred form is a rotary cutter assembly comprising a drill head which is adapted at an upper portion thereof for coupling to a drill string for rotation about a central axis. The drill head forms at a lower portion a plurality of receptacles. The receptacles are defined between a pair of opposing containment walls and are each dimensioned for receiving the shank of a drill bit. An axially extending groove and a transversely extending groove are formed in each of the containment walls. The shank of the drill bit has corresponding grooves which are complementary with the axial and transverse grooves formed in the drill head and are alignable with the drill head grooves upon reception of the shank in the receptacle. A pair of lock pins is receivable in the axially extending grooves and the complementary grooves of the received shank to secure the shank transversely relative to the drill head. A lock pin is receivable in each of the transverse grooves and the complementary grooves of the received shank to secure the shank axially relative to the drill head.

The transverse and axial grooves of the drill head preferably intersect. The drill head includes a transverse shoulder which defines an upper surface of the receptacle. The lock pins for the transverse grooves are dimensioned so that upon reception of the pins in the transversely extending grooves, the shank is forced to engage against the shoulder. The pins may also include a longitudinal threaded bore to facilitate removal of the pins from the cutter assembly.

In a preferred embodiment of the invention a wear sleeve is forced onto the assembly to extend circumferentially around the drill head and the received shanks to provide a shield which increases the wear characteristics of the cutter assembly. The wear sleeve may also function to seal a fluid passage formed in the shank for conducting lubrication fluid to the rotary bit assembly.

An object of the invention is to provide a new and improved rotary cutter assembly having improved means for removably securing a plurality of drill bit units to a drill head which cutter assembly also exhibits a high degree of structural integrity and improved durability characteristics.

Another object of the invention is to provide a new and improved rotary cutter assembly of sturdy construction which can be relatively easily assembled and dis-assembled in the field for replacement of one or more drill bit units.

Other objects and advantages of the invention will become apparent from the specification and the drawing.

DETAILED DESCRIPTION OF THE INVENTION

Figure 1:
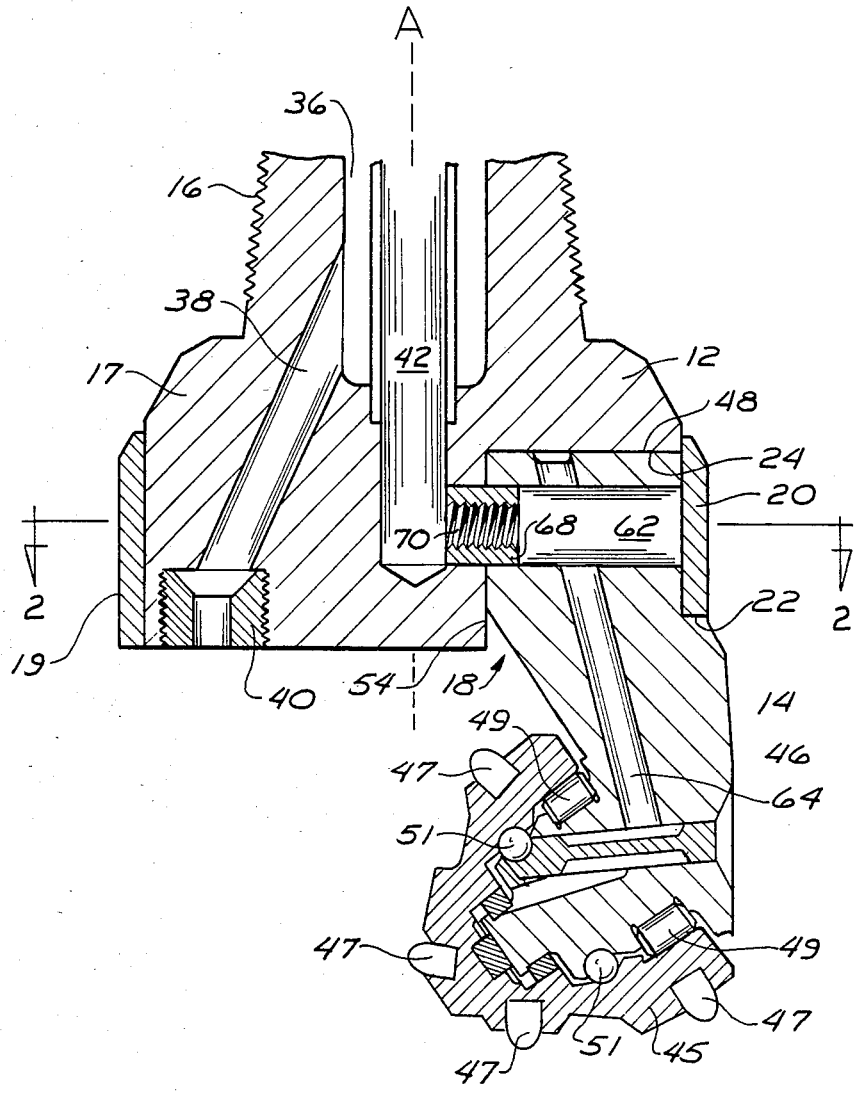
FIG. 1 is a side sectional view of a rotary cutter assembly of the present invention, said assembly incorporating one drill bit unit.

With reference to the drawing wherein like numerals represent like parts throughout the several FIGURES, a rotary cutter assembly 10 comprises a drill head 12 which is adapted for mountably receiving a plurality of rotary drill bit units 14 (only one of which is illustrated in the drawing). Rotary cutter assembly 10 rotates about a central generally vertical axis A with rotary cutters of the drill bit units 14 rotating about multiple axes in cooperating fashion to produce rotary cutting action for drilling wells, blast holes and the like.

Figure 2:
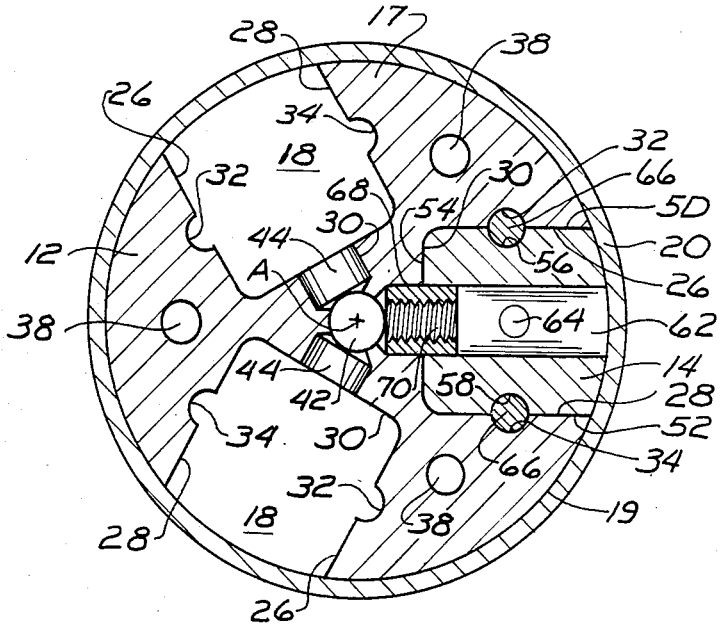
FIG. 2 is a cross-sectional view, partly in section and partly broken away, of the assembly of FIG. 1 taken along the line 2—2.

With reference to FIGS. 1 and 2, drill head 12 is adapted at the upper portion for attachment to the lower end of a drill string (not illustrated). In this regard, a tapered threaded portion 16 is provided to facilitate the attachment to the drill string. Drill head 12 may be generally described as a tapered cylindrical member flaring at the lower portion to form a coupling base 17 having an enlarged diameter. Drill head 12 is generally symmetrical about its central axis which is also the rotational axis A. At the lower base portion of the drill head 12 a plurality of angularly spaced receptacles 18 are symmetrically located relative to the central rotational axis A. Each receptacle is adapted to receive the shank of a drill bit unit 14 for releasable locking engagement therewith as will be described below. In a preferred form, the drill head has three equiangular spaced receptacles 18, but the invention has general applicability to any drill head mounting multiple drill bit assemblies.

The receptacles 18 are substantially identical. Each receptacle 18 is preferably of a substantially rectangular form with bevelled edges and a radial peripheral boundary having a slight curvature. Each receptacle opens axially downward relative to the rotational axis of drill head 12 and radially outwardly. Each receptacle 18 is defined at the top by a downwardly facing transverse abutment surface 24 of drill head 12. Each receptacle 18 is further defined by a pair of opposing containment walls 26 and 28 which extend in a substantially vertical orientation generally parallel to the central axis of rotation. An inner containment wall 30 is interposed between walls 26 and 28. A pair of generally centrally located, axially extending grooves 32 and 34 are formed in containment walls 26 and 28, respectively. Grooves 32 and 34 extend generally parallel to the central rotational axis A of drill head 12.

A longitudinal tubular passageway 36 generally symmetric about the rotational axis of the drill head is part of a fluid flushing system for transporting flushing fluid from the drill string through the rotary cutter assembly to the bottom of the hole which is being drilled. Passageway 36 obliquely communicates with a plurality of passageways 38 (only one of which is illustrated). Passageway 38 conducts flushing fluid to a nozzle 40 for a pressurized injection of flushing fluid into the bottom of the drill hole for forcing the cuttings away from the hole bottom, up the drilled bore and away from the drill string. Longitudinal passageway 36 communicates at the lower portion with a transition passageway 42 of reduced diameter. Passageway 42 communicates with a plurality of substantially transverse passageways 44 each of which open into a corresponding receptacle through containment wall 30.

Drill bit unit 14 generally comprises a roller cutter 45 which is rotatably joined to a shank 46. The roller cutter is conventionally of a form which comprises a substantially conically-shaped cutter shell carrying a plurality of cutter teeth 47 formed of tungsten, carbide, steel or other durable material. A plurality of roller bearings 49 and ball bearings 51 are permanently located at the rotational interface between the roller cutter and the shank 46.

Shank 46 is contoured at the upper portion thereof so that the shank may be closely received in receptacle 18. Shank 46 therefore includes an upper abutment surface 48, dimensioned for receptive engagement with surface 24 and generally planar rectangular surfaces 50, 52 and 54 which are dimensioned to be closely accommodated between containment walls 26, 28 and 30, respectively. Each of opposing surfaces 50 and 52 are traversed by grooves 56 and 58, respectively, which grooves are dimensioned and located to be complementary to corresponding grooves 32 and 34 and alignable therewith so that when the shank is received in receptacle 18, groove 32 closely aligns with groove 56 and groove 34 closely aligns with groove 58 to form a pair of generally cylindrical parallel slots.

A transverse passageway 62 extends generally transversely through the shank. A fluid passageway 64 obliquely communicates with transverse passageway 62 and leads to the bearing assembly. The passageways function to conduct compressed air to the bearing assembly to provide a means for freeing the bearings from particulate matter generated by the cutting action of the roller cutters.

The drill bit unit 14 is rigidly locked to the drill head by means of a pair of opposing lock pins 66 which are received in the respective slots formed by the opposed complementary groove 32 and 56 and the opposed complementary grooves 34 and 58. Grooves 56 and 58 terminate at respective spaced lower retaining shoulders (not illustrated for FIG. 1 and 2 embodiment) to retain the lock pins in fixed axial postion within the slots. The lock pins 66 are generally elongated cylindrical solid members which upon reception in the slots as previously described are oriented so that the longitudinal axes of the pins are substantially parallel to the axis of rotation of the drill head. The foregoing pin locking arrangement thus locks the bit assembly in fixed transverse relationship to the drill head.

A lock sleeve 68 such as disclosed in U.S. patent application Ser. No. 580,368 filed Feb. 15, 1984 is threadably inserted in the aligned abuting ends of both transverse passageway 44 and passageway 62 to connect the passageways and rigidly lock the shank at a fixed axial position relative to the drill head. The lock sleeve 68 forms an internal passageway defined by an internal threaded region 70. Threaded region 70 provides an engagement surface so that the lock sleeve 68 may be threadably engaged by a tool inserted through passageway 62 for forceably removing the lock sleeve from the passageway to release the bit unit from the drill head. The passageway defined by the lock sleeve provides a fluid passageway for providing compressed air to the bearing assembly.

In a preferred form of the invention, three receptacles are provided in drill head 12 and three bit units substantially identical to that previously described are each received in a corresponding receptacle and locked in place as described above. The foregoing described locking assembly securely locks each bit unit to the drill head and also provides a means for relatively easily removing a drill bit unit in the field should it become necessary to replace one or more such bit units. Each drill bit unit may be locked to the drill head and/or removed from the drill head independently of the other bit assemblies.

The lower exterior portion of drill head 12 conforms with the exterior surfaces of the received shanks to form a generally cylindrical peripheral surface 19 which closely receives a coaxial circumferentially extending wear sleeve 20. Cylindrical surface 19 is segmented at the lower extremes by the radially protruding portions of the shanks. Wear sleeve 20 is preferably constructed of steel and, in a preferred form, has a 5½ inch inside diameter. The wear sleeve is mounted to the drill head by means of a 0.005 inch interference fit by a process wherein the wear sleeve is heated to approximately 400° F. and forced onto the cylindrical mounting surface 19. Wear sleeve 20 generally is positioned to align flush with the bottom of the drill head. Equiangularly spaced notches 22 having circumferential dimensions generally commensurate with those of receptacles 18 are formed around the lower portion of the sleeve in alignment with receptacles 18 for accommodating the radial protrusion of the drill bit units. It should be appreciated that the wear sleeve 20 functions to both seal the transverse passageway 62 and to increase the wear characteristics of the cutter assembly by providing an outer protective barrier against the highly destructive cuttings which impinge against the cutter assembly during drilling operations.

In an alternate embodiment of the invention (not illustrated), lock pins 66 may be integrally formed or permanently attached to shank 46 at the location of grooves 56 and 58 or permanently attached to the drill head at the location of groves 32 and 34. Alternately, a lock pin may be employed in place of the lock sleeve 68 to secure the bit assembly axially relative to the drill head.

Figure 3:
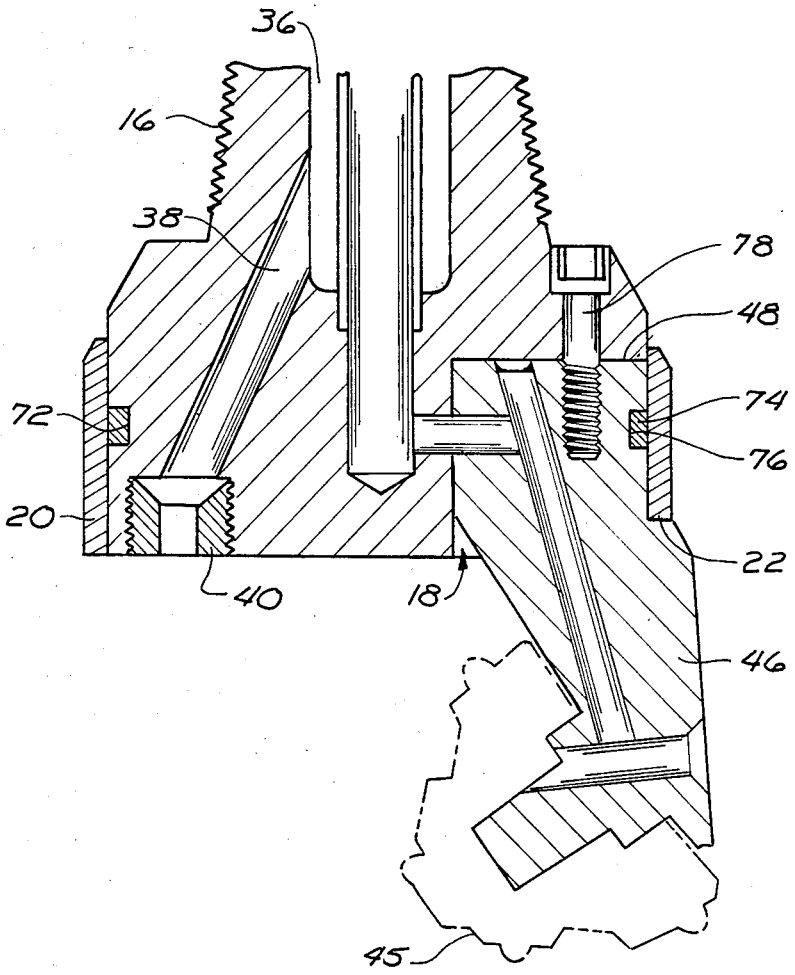
FIG. 3 is a side sectional view, partly in section and partly in phantom, of a second embodiment of the rotary cutter assembly of the present invention.

With reference to FIG. 3, the exterior surface of the drill head may be traversed with a peripheral segmented circumferential slot 72 which aligns with a corresponding slot 76 formed at the exterior of each shank for receiving a lock ring 74. Lock ring 74 is preferably a split steel ring which is welded in place. Ring 74 exteriorly abuts the interior surface of wear sleeve 20. Thus, lock ring 74 upon reception in slots 72 and 76 functions to retain the bit unit in fixed axial position relative to the drill head. The lock ring may be used in addition to or as an alternative to lock sleeve 68.

With further reference to FIG. 3, an Allen-head bolt 78 is threaded from an upper shoulder portion of the drill head through the upper abutment surface 48 into the shank 46 for securing the bit assembly to the drill head. The Allen-head bolt 78 may be used as an alternative or in addition to the foregoing described lock sleeve 68, lock pins 66, and/or lock ring 74. The Allen-head bolt is prevented from movement after the bit assembly is bolted to the drill head as illustrated since the head of the bolt 78 is flush with the top of the drill head coupling base.

Figure 4:
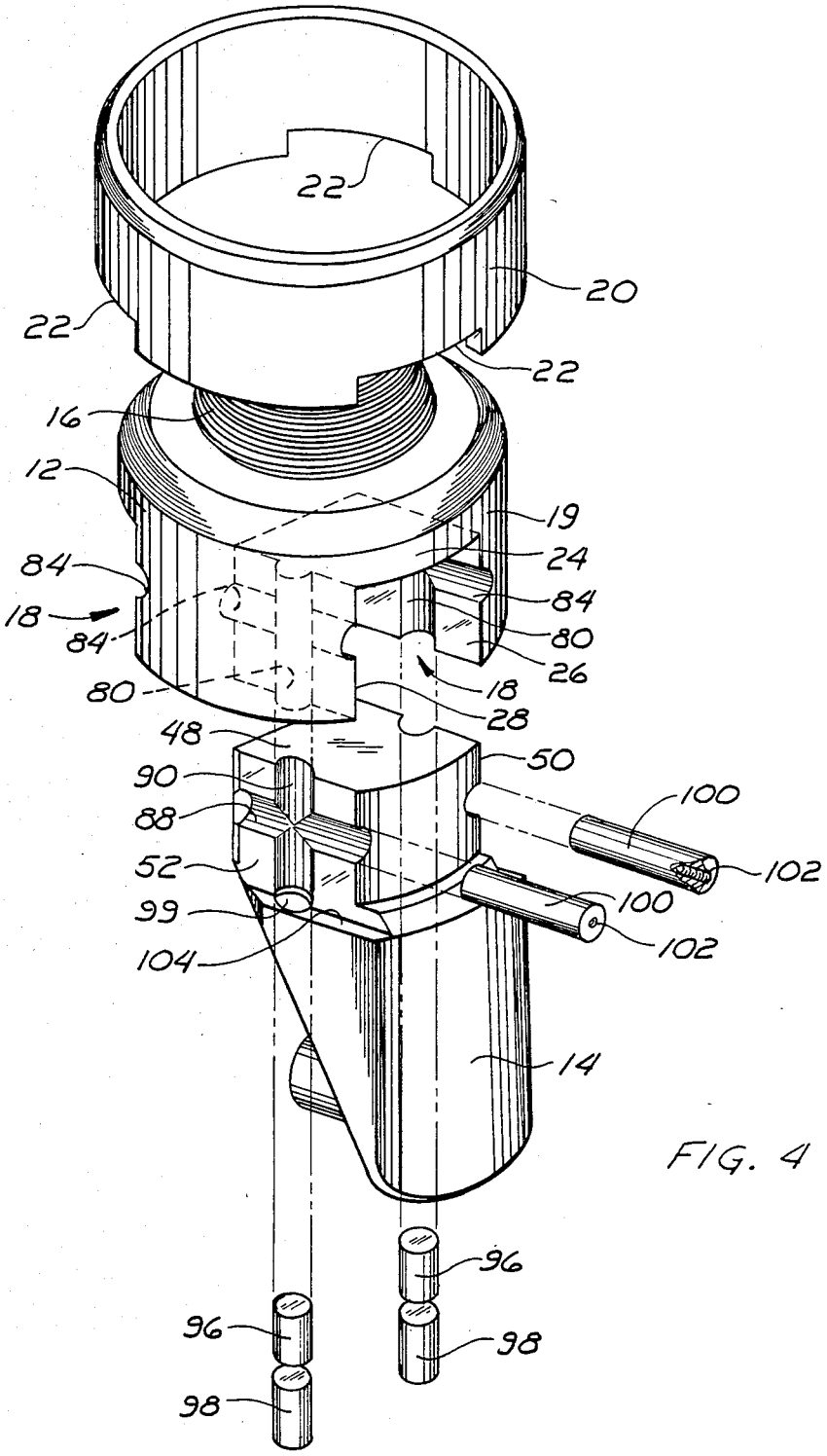
FIG. 4 is a fragmentary exploded view, partly in phantom, of a third embodiment of the rotary cutter assembly of the present invention.

With reference to FIG. 4, another embodiment of the invention is illustrated wherein opposing containment walls 26 and 28 of receptacle 18 are respectively traversed by mutually intersecting axial grooves 80 extending generally parallel to the central rotational axis and transverse grooves 84 extending generally orthogonally to the central rotational axis. The shank 46 of the drill bit unit is configured so that spaced surfaces 50 and 52 are traversed by complementary axial grooves 88 and transverse grooves 90 which align with corresponding grooves 80 and 84, respectively, upon reception of the shank in the receptacle. Pairs of short lock pins 96 and 98 are inserted into the slots formed by the adjacent complementary axial grooves for transversely locking the drill bit assembly to the drill head. A shoulder 99 generally perpendicular to the central axis of rotation is formed in the shank for vertically retaining the pins.

A long dowell lock pin 100 is received in each of the slots defined by the adjacent complementary transverse grooves 84 and 90 to axially lock the drill bits with the drill head. Each lock pin 100 intermediately engages adjacent ends of lock pins 96 and 98 which latter pins are disposed at right angles to lock pin 100. The long lock pins 100 and grooves 84 and 90 are dimensioned so that when the pins are forced into the corresponding slots formed by the transverse grooves, the upper abutment surface of the shank 48 is forced against the transverse abutment surface 24 of the drill head and the pins 100 are securely wedged in position between the groove walls of the drill head and the shank. In addition or in the alternative, a transverse side shoulder 104 of the bit unit 14 may be forced into engagement against the underside of the coupling base 17 of the drill head. In preferred form, a dimensional mismatch on the order of 0.005 inches is sufficient to produce the required wedging-type or interference fit action. The outer end portion of pins 100 includes a longitudinal threaded bore 102. The threaded bore 102 functions to provide an engagement structure to facilitate the forceful removal of the pins to disengage the bit from the drill head. The wear sleeve 20 may also be forced onto the assembly as previously described to retain the lock pins 100 to the drill head and to provide a shield from the cuttings which are blasted against the cutter assembly during drilling operations.

The foregoing description is set forth for purposes of illustrating a preferred form of the invention and should not be deemed a limitation of the invention herein. Accordingly, various modifications, adaptations and alternatives may occur to one skilled in the art without departing from the spirit and scope of the present invention.

What is claimed is:

1. A rotary cutter assembly comprising:

a drill head adapted at an upper portion thereof for coupling to a drill string for rotation about a central axis and having at a lower portion thereof a plurality of angularly spaced receptacles defined between a pair of opposing containment walls and adapted for receiving a shank of a drill bit unit;

each said containment wall being traversed by an axial groove extending substantially parallel to the central rotational axis and a transverse groove extending substantially orthogonally to the central rotational axis;

at least one bit unit comprising a shank receivable in a said receptacle and having axial and transverse grooves complementary with said longitudinal and transverse grooves of said drill head and cooperatively alignable therewith upon reception of said shank in a said receptacle;

first lock pin means receivable in said complementary axial grooves of said drill head and the said shank to releasably secure the shank transversely relative to the drill head; and second lock pin means receivable in said complementary transverse grooves of said drill head and the said shank to releasably secure the shank axially relative to the drill head.

2. The rotary cutter assembly of claim 1 wherein said transverse and axial grooves intersect and said first lock pin means includes a pair of pins for each axially extending groove of said drill head.

3. The rotary cutter assembly of claim 1 wherein said drill head includes a shoulder defining an upper portion of each said receptacle and said second lock pin means includes a dowel pin which is dimensioned so that upon reception of said pin in the transverse grooves of the shank and drill head, the shank is forced to engage the shoulder thereby resulting in an interference fit between the shank and the drill head.

4. The rotary cutter assembly of claim 3 wherein said dowel pin includes a longitudinal threaded bore opening through an end of said pin.

5. The rotary cutter assembly of claim 1 wherein said bit unit further includes a pair of spaced retention shoulders and said first lock pin means comprises a plurality of pins which are retained in an axially fixed position in said axial grooves by means of said retention shoulders.

6. A rotary cutter assembly comprising:

a drill head adapted at an upper portion thereof for coupling to a drill string for rotation about a central axis and having at a lower portion thereof a plurality of angularly spaced receptacles defined between a pair of opposing containment walls and adapted for receiving a shank of a drill bit unit, said lower portion forming a segmented cylindrical peripheral surface extending between said receptacles;

at least one drill bit unit comprising a shank which is receivable in a said receptacle;

locking means to releasably secure the shank in said receptacle in a fixed position with said drill head; and a wear sleeve extending circumferentially of said drill head and interiorly engaging said segmented cylindrical surface and said shank.

7. The rotary cutter assembly of claim 6 wherein the drill head further forms a segmented peripheral slot and each said shank forms a peripheral slot alignable with said drill head slot and said locking means further comprises a lock ring received in aligned slots of said drill head and shank.

8. The rotary cutter assembly of claim 6 wherein the drill head forms an upper shoulder and said locking means comprises a bolt extending through said shoulder and threadably engageable with a said shank received in a said receptacle.

9. A rotary cutter assembly comprising:

a drill head adapted at an upper portion thereof for coupling to a drill string for rotation about a central axis and having at a lower portion thereof a plurality of angularly spaced receptacles defined between a pair of containment walls, said head having a longitudinal fluid passageway communicating with a first transverse passageway opening into each said receptacle and forming a cylindrical peripheral surface extending between said receptacles;

at least one bit unit comprising a shank receivable in a said receptacle, said shank having a second fluid passageway which is alignable with said first fluid passageway and extends through said shank generally perpendicularly to the central rotational axis of said drill head upon reception of said shank in a said receptacle;

locking means and releasably securing said bit assembly to said head by connecting said first and second fluid passageways; and a wear sleeve extending circumferentially of said drill head and engaging said cylindrical peripheral surface, said second fluid passageway of said shank being sealed by means of said wear sleeve.

* * * * *